US005097896A

United States Patent [19]

Belcher et al.

[11] Patent Number: 5,097,896

[45] Date of Patent: Mar. 24, 1992

[54] HEAT EXCHANGER

[75] Inventors: Bryan L. Belcher, Warwickshire; Alan Bond, Oxfordshire, both of England

[73] Assignee: Rolls-Royce plc, London, England

[21] Appl. No.: 241,222

[22] Filed: Aug. 12, 1988

[30] Foreign Application Priority Data

Aug. 15, 1987 [GB] United Kingdom ..... 8719446

[51] Int. Cl.[5] ..... F28D 7/10

[52] U.S. Cl. ..... 165/140; 165/141; 165/165; 165/173

[58] Field of Search ..... 165/140, 141, 165, 173

[56] References Cited

U.S. PATENT DOCUMENTS 3,118,498 1/1964 Bergdoll ..... 165/173
3,400,759 9/1968 Legrand ..... 165/173
4,089,370 5/1978 Marchal ..... 165/163
4,134,195 1/1979 Jacobsen ..... 165/173
4,440,217 4/1984 Stieler ..... 165/155

*Primary Examiner*—Donald P. Walsh
*Attorney, Agent, or Firm*—Cushman, Darby & Cushman

[57] ABSTRACT

A heat exchanger comprises concentric annular arrays of parallel feeder tubes and receiver tubes which are interconnected by generally circumferentially extending heat exchanger tubes. Each heat exchanger tube interconnects one feeder tube with a corresponding receiver tube which is angularly spaced apart therefrom. In operation a first fluid flows over the heat exchanger tubes while a second fluid flows through the heat exchanger tubes. The heat exchanger tubes are so arranged that the fluid flowing through them has a component which is opposite to that of the fluid flowing over them.

8 Claims, 2 Drawing Sheets

HEAT EXCHANGER

This invention relates to heat exchangers and in particular to heat exchangers which are compact, lightweight and efficient.

Heat exchangers which are intended for use on aerospace vehicles must, necessarily, be compact, lightweight and efficient. Such objectives can be difficult to achieve, especially if the vehicle concerned has a requirement for a large capacity heat exchanger. For example, aerospace vehicles which are intended to operate both in the atmosphere and trans-atmospherically may be provided with engines which are capable of operation both in the atmosphere and trans-atmospherically. Such an engine is described in UK Patent Application 8430157 in which heat exchangers through which liquid hydrogen for fuel use is passed, are suitably positioned to be in heat exchange relationship with air which is subsequently directed into the compressor of the engine.

In such heat exchangers, it is desirable to achieve the performance which can be expected from a contra-flow arrangement i.e. an arrangement in which the two fluids in heat exchange relationship generally flow in opposite directions. In a compact heat exchanger, this can entail the provision of tubes within the heat exchanger for containing one of the fluids which are of generally sinuous configuration. This ensures a large area over which the fluids are in heat exchange relationship. However the resultant bends in the tubes give rise to frictional and turning losses in the fluid passing through the tubes. Moreover it can be difficult to seal the ends of the tubes to a manifold and tubes which are so configured tend to be heavy. In addition, constraints imposed upon the minimum bend radii of the tubes can also result in a heat exchanger which is bulkier than is desirable.

It is an object of the present invention to provide a heat exchanger which is sufficiently lightweight, compact and efficient to be considered for use in inter alia aerospace applications.

According to the present invention, a heat exchanger for placing two fluids in heat exchange relationship comprises an array of spaced apart feeder tubes and an array of spaced apart receiver tubes, which arrays are operationally interposed between high and low pressure regions of one of said fluids so that said fluid flows over said feeder and receiver tubes, said feeder tubes being located downstream of said receiver tubes with respect to said fluid flow thereover, each of said feeder tubes being interconnected with a corresponding one of said receiver tubes by a plurality of heat exchanger tubes, each of which heat exchanger tubes being so configured that its total extent lies generally transverse to the direction of said fluid flow, said feeder tubes operationally containing the other of said fluids and adapted to direct said other fluid through said heat exchanger tubes to said receiver tubes.

The invention will now be described, by way of example, with reference to the accompanying drawings in which.

Figure 1:
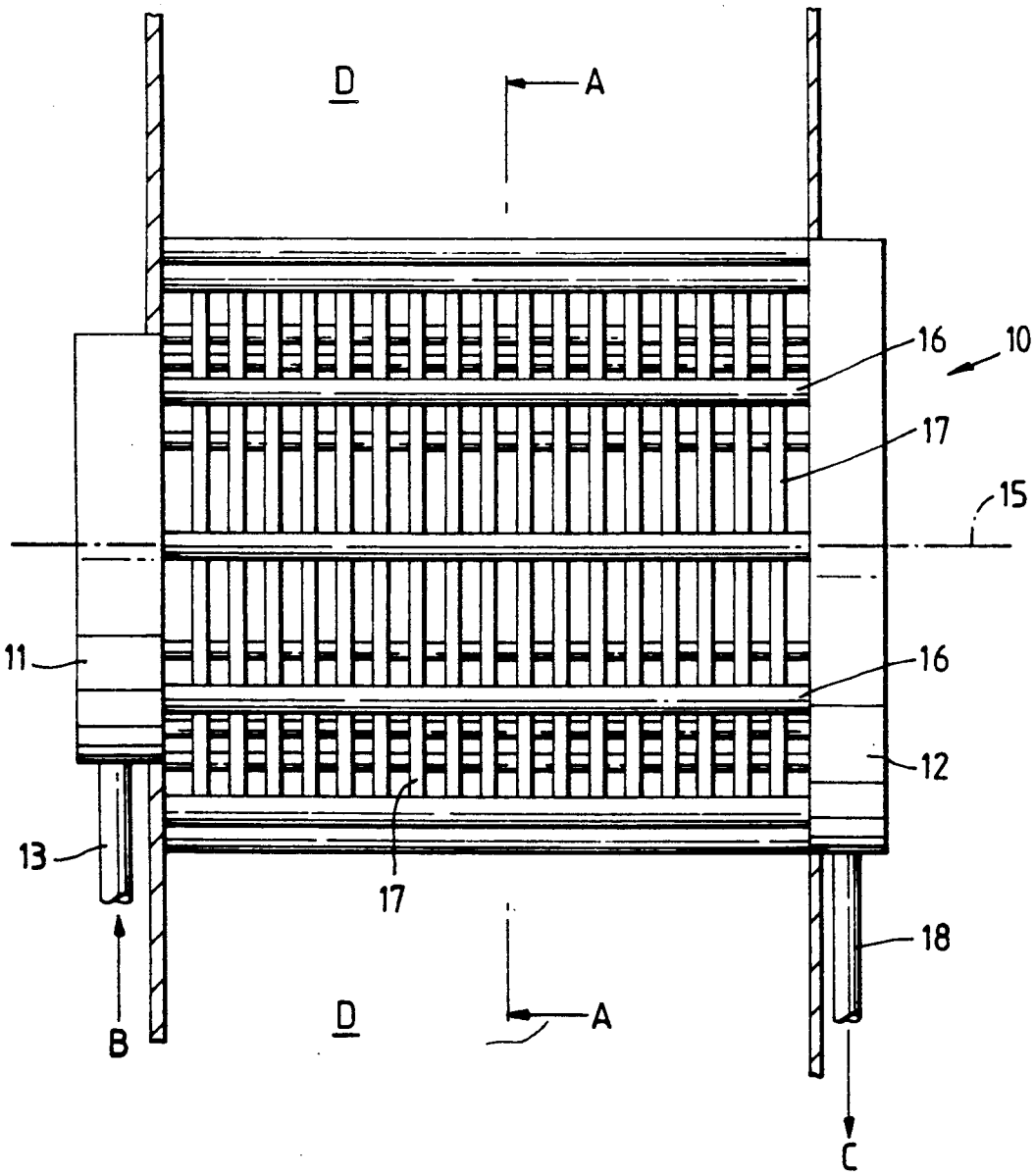
FIG. 1 is a side view of a heat exchanger in accordance with the present invention.

With reference to FIG. 1, a heat exchanger generally indicated at 10 comprises an annular inlet manifold 11, and an annular outlet manifold 12.

The inlet manifold 11, into which is directed a first fluid through a duct 13 as indicated by the arrow B, has an annular array of feeder tubes 14 (which can be seen in FIG. 2) attached to it and in communication with its interior. The feeder tubes 14 are equally spaced apart around the longitudinal axis 15 of the inlet manifold 11 and abut, but are not in communication with the interior of, the outlet manifold 12.

The outlet manifold 12 is coaxial with the longitudinal axis 15 and has an annular array of receiver tubes 16 attached to it and in communication with its interior. Like the feeder tubes 14 the receiver tubes 16 are equally spaced apart around the longitudinal axis 15.

The inlet manifold 11 has smaller external and internal diameters than the outlet manifold 12 so that the feeder tubes 14 are located radially inwardly, with respect to the longitudinal axis 15, of the receiver tubes 16 resulting in the arrays of feeder tubes 14 and receiver tubes 16 being concentric. It will be observed that the feeder tubes 14 and the receiver tubes 16 are parallel with each other.

Figure 2:
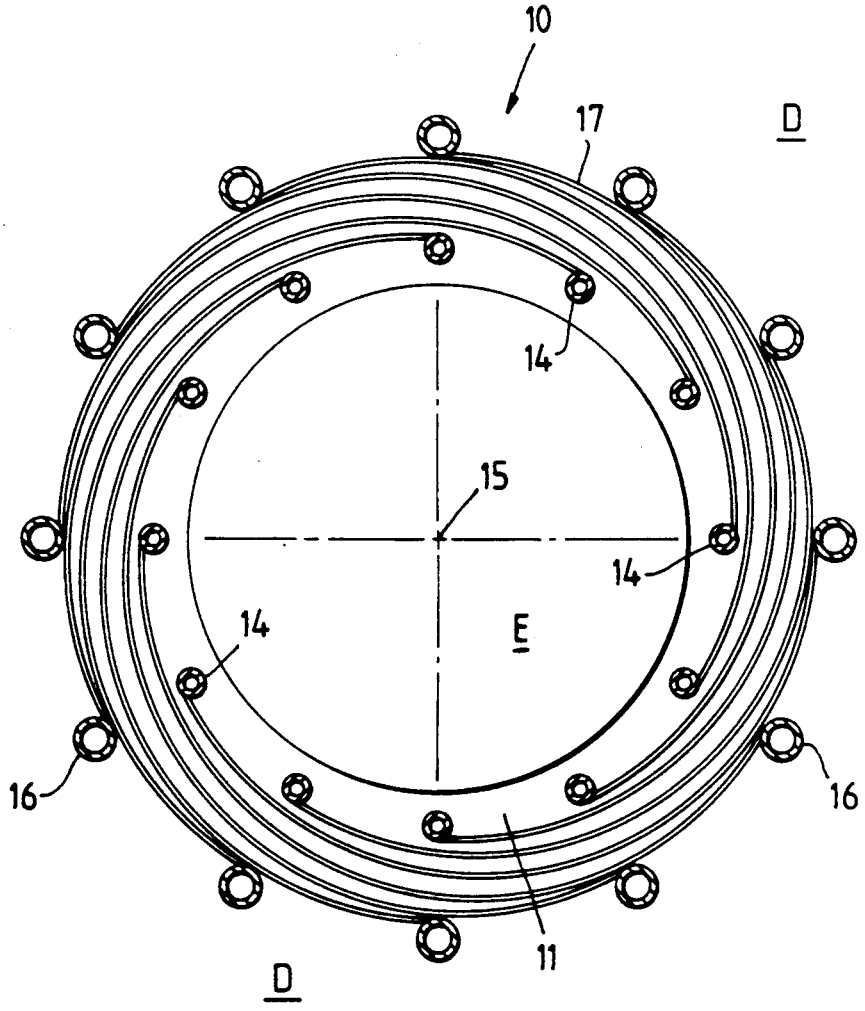
FIG. 2 is a view section line A—A of FIG. 1.

The feeder tubes 14 and the receiver tubes 16 are interconnected by a large number of heat exchanger tubes 17 all of which are the same length and may be dimpled to increase their surface area and some of which can be seen in FIG. 2. Each heat exchanger tube 17 extends in a generally circumferential direction and is of curved configuration so that it interconnects the radially outermost extent of a feeder tube 14 and the radially innermost extent of a corresponding receiver tube 16. In order that an adequate number of heat exchanger tubes 17 may be interposed between the feeder tube 14 and receiver tube 16 arrays in the particular heat exchanger 10, each heat exchanger tube 17 extends between a feeder tube 14 and a receiver tube 16 which is offset by some 150° therefrom. It will be appreciated however than the amount of angular off-set between each feeder tube 14 and its corresponding receiver tube 16 i.e. the receiver tube to which it is connected by the heat exchanger tubes 17, is a matter of choice depending upon the required performance of the heat exchanger 10.

In operation, a first fluid to be placed in heat exchange relationship with a second fluid is directed into the inlet manifold 11 through the duct 13 as indicated by the arrow B. The fluid then flows into the feeder tubes 14 from where it flows through the heat exchanger tubes 17 into the receiver tubes 16 and then into the outlet manifold 12 from where it is exhausted through the duct 18 as indicated by the arrow C.

The majority of the external circumferential surface of the heat exchanger 10 confronts a region D containing the second fluid. The fluid in the region D is arranged to be at a higher pressure than that in the region E defined by the internal circumferential surface of the heat exchanger 10. This being so, there is a flow of the second fluid from the region D into the region E which is generally radial in direction with respect to the longitudinal axis 15. It will be seen therefore than since the first fluid flows from the feeder tubes 14 to the receiver tubes 16 in a direction which has a radial component, the first and second fluids are in a generally cross-flow relationship. This being so, the high heat exchanger coefficients associated with cross-flow tube arrangements are enjoyed by heat exchangers in accordance with the present invention. Moreover since the flows of both the first and second fluids within the heat exchanger 10 involve minimal turning, the losses associated with flow turning are similarly minimised. This, together with ability to closely pack the heat exchanger tubes 17 ensures that heat exchangers in accordance with the present invention are very compact and efficient.

Other advantages enjoyed by heat exchangers in accordance with the present invention include a very economical use of materials so that the heat exchanger 10 is light in weight. Moreover the fact that all of the heat exchanger tubes 17 are the same length and are of spiral layout ensures that the heat exchanger 10 is very tolerant of thermal gradients which could otherwise give rise to thermal stresses within its structure.

Although the heat exchanger 10 has been described with reference to a situation in which the second fluid in the region D is at a higher pressure than that within the region E, the situation could be reversed. However in such a situation, the flow of the first fluid would also have to be reversed so that it flows from the manifold 12 to the manifold 11 i.e the flow through the heat exchanger tubes 17, as will as being partially circumferential, would also be generally radially inward, not outward.

It will be appreciated that although the heat exchanger 10 has been described as being generally annular, it may in certain circumstances be of a different form. Thus it may, for instance be flat, in which case the heat exchanger tubes 17 would be straight and generally diagonally extending between corresponding feeder and receiver tubes 14 and 16.

Heat exchanges in accordance with the present invention are, by virtue of their efficiency, light weight and compactness particularly useful in aerospace applications. Thus in one aerospace application in an engine of the type described in UK Patent Application 8430157, the fluid in regions D and E would be air and the fluid within the heat exchanger tubes 17 would be liquid hydrogen. Such a heat exchanger would be situated in the air intake of the engine.

We claim:

1. A heat exchanger for placing two fluids in heat exchange relationship comprising an array of spaced apart feeder tubes and an array of spaced apart receiver tubes, which arrays are operational interposed between high and low pressure regions of one of said fluids so that said fluid flows over said feeder and receiver tubes, said feeder tubes being located downstream of said receiver tubes with respect to said fluid flow thereover, each of said feeder tubes being interconnected with a corresponding one of said receiver tubes by a plurality of heat exchange tubes, each of which heat exchanger tubes is so configured that its total extent lies generally transverse to the direction of said fluid flow, said feeder tubes operationally containing the other of said fluids and adapted to direct said other fluid through said heat exchanger tubes to said receiver tubes.

2. A heat exchanger as claimed in claim 1 wherein in operation the heat exchanger is arranged so that said fluid flow within said heat exchanger tubes has a component which is opposite to that of said other fluid flowing over said heat exchanger tubes.

3. A heat exchanger as claimed in claim 1 wherein said feeder tubes and receiver tubes are respectively arranged in concentric annular arrays.

4. A heat exchanger as claimed in claim 3 wherein said heat exchanger tubes are generally circumferentially extending so as that each of said heat exchanger tubes interconnects one of said feeder tubes and a corresponding one of said receiver tubes which said feeder and receiver tubes are angularly spaced apart from each other.

5. A heat exchanger as claimed in claim 3 wherein said feeder tubes are positioned radially inwardly of said receiver tubes.

6. A heat exchanger as claimed in claim 1 wherein said feeder and receiver tubes are respectively connected to first and second manifolds which in operation respectively direct fluid to said feeder tubes and receive fluid from said receiver tubes.

7. A heat exchanger as claimed in any claim 1 wherein said feeder and receiver tubes are parallel with each other.

8. A heat exchanger as claimed in claim 1 wherein said heat exchanger tubes are of equal length.

* * * * *